US009572739B1

(12) United States Patent
Bell

(10) Patent No.: US 9,572,739 B1
(45) **Date of Patent: *Feb. 21, 2017**

(54) APPARATUS AND METHOD FOR FACILITATING OR ENHANCING A PERSON'S BREATHING

(71) Applicant: Deborah L. Bell, Destin, FL (US)

(72) Inventor: Deborah L. Bell, Destin, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/886,508

(22) Filed: Oct. 19, 2015

Related U.S. Application Data

(63) Continuation of application No. 13/270,033, filed on Oct. 10, 2011, now Pat. No. 9,265,681.

(51) Int. Cl.

| | |
|---|---|
| ***A61G 7/07*** | (2006.01) |
| ***A47C 20/04*** | (2006.01) |
| *A61G 5/12* | (2006.01) |

(52) U.S. Cl.

CPC ..... *A61G 7/07* (2013.01); *A47C 20/04* (2013.01); *A61G 2005/121* (2013.01); *A61G 2005/122* (2013.01)

(58) Field of Classification Search

CPC .. A47G 9/1009; A47G 9/1081; A61G 13/121; A61G 7/072; A61G 7/065; A61G 7/07; A61G 13/1255; A61G 13/1225; A61G 2013/0554; A61G 13/1215; A47C 20/027; A47C 7/425; A47C 16/005; A47C 7/46; B60N 2/66; B60N 2/643; B60N 2/22

USPC .... 5/622, 630, 632, 634, 636–640; 128/845, 128/848; 297/284.4, 284.5, 284.7, 284.8

See application file for complete search history.

(56) References Cited

U.S. PATENT DOCUMENTS

| | | | | |
|---|---|---|---|---|
| 3,973,797 | A | 8/1976 | Obermeier et al. | |
| 4,182,533 | A | 1/1980 | Arndt et al. | |
| 4,313,637 | A | 2/1982 | Barley | |
| 4,350,388 | A | 9/1982 | Weiner | |
| 4,601,514 | A | 7/1986 | Meiller | |
| 4,850,067 | A | 7/1989 | Latorre | |
| 5,112,106 | A | 5/1992 | Asbjornsen et al. | |
| 5,360,258 | A | 11/1994 | Alivizatos | |
| 5,479,667 | A | 1/1996 | Nelson et al. | |
| 5,567,011 | A | 10/1996 | Sessini et al. | |
| 5,713,841 | A | 2/1998 | Graham | |
| 5,926,880 | A | 7/1999 | Sramek | |
| 6,079,785 | A | 6/2000 | Peterson et al. | |
| 6,092,871 | A | 7/2000 | Beaulieu | |
| 6,428,497 | B1 | 8/2002 | Crouch | |
| 6,532,962 | B1 | 3/2003 | Walker et al. | |
| 6,648,838 | B1 * | 11/2003 | Brandon | A61B 5/103 128/845 |

(Continued)

FOREIGN PATENT DOCUMENTS

| | | | | |
|---|---|---|---|---|
| JP | WO 2005013868 A1 * | 2/2005 | ..... | A61F 5/56 |
| WO | 2005/013868 A1 | 2/2005 | | |

*Primary Examiner* — David E Sosnowski

*Assistant Examiner* — Eric Kurilla

(74) *Attorney, Agent, or Firm* — Patterson & Sheridan, LLP

(57) ABSTRACT

An apparatus and method for facilitating or enhancing a person's breathing. The method provides for supporting the person's shoulders and elevating the person's spine, so as to enable the person's body weight to be distributed in the person's shoulders, expanding the person's chest cavity to enhance oxygen intake. The apparatus is especially adapted to perform the functions of the method.

15 Claims, 5 Drawing Sheets

(56) References Cited

U.S. PATENT DOCUMENTS

| | | | | |
|---|---|---|---|---|
| 6,749,261 | B2 | 6/2004 | Knoblock et al. | |
| 6,786,545 | B2 | 9/2004 | Bargheer et al. | |
| 6,969,366 | B1 | 11/2005 | Reddick | |
| 7,077,141 | B2 | 7/2006 | Troop | |
| 7,213,596 | B2 | 5/2007 | Saied | |
| 8,316,855 | B2 | 11/2012 | Lee | |
| 8,424,137 | B1 * | 4/2013 | Pearce | A47C 27/085 5/630 |
| 2002/0059680 | A1 | 5/2002 | Mahoney et al. | |
| 2005/0253434 | A1 * | 11/2005 | Bowman | A47C 1/023 297/284.4 |
| 2006/0097556 | A1 | 5/2006 | Jang | |
| 2006/0253986 | A1 | 11/2006 | Rubio | |
| 2007/0240723 | A1 | 10/2007 | Hong et al. | |
| 2008/0134437 | A1 | 6/2008 | Small | |
| 2009/0038077 | A1 | 2/2009 | Han et al. | |
| 2009/0177121 | A1 | 7/2009 | Brandon et al. | |
| 2010/0078974 | A1 | 4/2010 | Nathan | |
| 2010/0299835 | A1 | 12/2010 | Andrews | |
| 2011/0048429 | A1 | 3/2011 | Callahan | |
| 2011/0056503 | A1 | 3/2011 | Abraham | |
| 2011/0265264 | A1 | 11/2011 | Reeder, Jr. | |
| 2012/0053480 | A1 | 3/2012 | Ueda | |
| 2012/0256456 | A1 | 10/2012 | Nekrasov | |

* cited by examiner

APPARATUS AND METHOD FOR FACILITATING OR ENHANCING A PERSON'S BREATHING

CROSS-REFERENCE TO RELATED APPLICATIONS

This is a continuation application of U.S. patent application Ser. No. 13/270,033, filed Oct. 10, 2011, which is herein incorporated by reference.

BACKGROUND OF THE INVENTION

1. Field of the Invention

The present invention relates to medical devices and more particularly to breathing assistance devices. Most particularly, the present invention relates to an apparatus suitable for facilitating or enhancing a person's breathing.

2. Description of Relevant Art

A common problem encountered with sensory and consciousness deficient patients confined to hospital beds, operating tables, wheelchairs, and even beds at home is poor posture, or slumping and sliding of the patient into uncomfortable and even dangerous positions, in particular positions that inhibit the flow of oxygen to the patient's respiratory system.

This phenomenon may be observed in hospitals, nursing homes, hospices, emergency rooms, ambulances, and pediatric wards, among others. In particular, the inventor observed her mother, Marie J. Parish, experiencing these very issues during her final days in a critical care stroke unit and, based on her observations of her mother's suffering at that time, was driven to find a solution.

Breathing problems can occur in any situation where the patient has a respiratory disease or chronic pulmonary obstructive disease, has sleep apnea, is disabled, is sedated or comatose, has ketosis associated with diabetes, has had a stroke, is in shock, has emphysema, or any other type of medical condition where the patient is not able to keep him or herself in a proper position to enhance the flow of oxygen. It should also be noted that the quality of life of the patients in these conditions may also be severely impacted by the same problem.

Respiratory disease is a significant contributor to morbidity and mortality in the United States. Lung diseases, excluding lung cancer, constitute 8% of all hospice admissions and are the fifth most common primary illness of hospice patients. Chronic lower respiratory disease was responsible for nearly 125,000 deaths in the United States in 2006 and that death rate continues to rise, especially among elderly men.

Most of the literature on care of patients with chronic respiratory disease has been focused on chronic pulmonary obstructive disease (COPD). Relatively little study has been done on palliative and hospital/hospice care of patients with restrictive lung diseases such as pulmonary fibrosis and genetic diseases such as cystic fibrosis.

It is readily observable, however, that many, if not all, hospice patients with any type of respiratory disease, are in a slumped position with poor body posture for breathing. This exacerbates the lack of airflow from the already compromised breathing of the patient.

Another common problem encountered by rescuers of unconscious, non-breathing victims, is that the victim's airway is closed. A skilled rescuer is trained to manually hyperextend the victim's neck, and/or perform an alternative maneuver called a chin lift. Such procedures are inherently difficult to perform correctly and reliably. A rolled up towel or foam may be used to facilitate the procedures, but these aids are not automatically deployable and tend to provide poor or inconsistent results with an inexperienced user. The chief alternative in the prior art has been to perform endotracheal intubation or surgical tracheotomy. Even those alternative procedures, however, can be difficult to perform on an obese patient.

A need exists for easily and dependably facilitating or enhancing the breathing of patients with respiratory disease, accident victims and others.

SUMMARY OF THE INVENTION

The present invention provides an apparatus and method for facilitating or enhancing a person's breathing by aligning and opening the person's breathing passages, whether the person is in a reclining position or in a sitting position. In this method, the person's upper body, particularly their back extending from their neck to slightly below their diaphragm, and especially the person's shoulder blades, are supported, and the person's backbone/spine is elevated, such that the person's weight falls back on or into the person's shoulder blades and neck area, thereby enhancing the person's lung capacity in the chest area. The person's chest cavity is also elevated upwards, facilitating or improving expansion of the person's lungs and other organs, including the heart, to enhance oxygen intake. Optionally, the base of the person's skull and neck may be cradled and supported such that it facilitates alignment of the person's skull and neck thereby aligning or opening the person's airways, such as the oral, pharyngeal and/or laryngeal structures.

The apparatus of the invention has structural features that affect the person's weight distribution to accomplish the method of the invention. The apparatus extends from the person's neck to an area generally below the person's diaphragm, to support the person's shoulder blades and backbone/spine and to position the person's spine upwards such that the person's shoulders open and otherwise enhance the person's airways, distributing the person's weight into the shoulders, and often times relieving pressure on the person's lungs in the chest area. The apparatus has a raised backbone portion to be positioned along the person's spine, to elevate the person's chest cavity upwards. This backbone portion may potentially be raised horizontally, vertically, rotationally, or even at an angle to be positioned across the person's back.

The apparatus of the invention may optionally further comprise an upper or head portion for cradling the person's head at the base of the person's skull and neck to help align or open the oral, pharyngeal and/or laryngeal structures comprising the person's airways and a support portion adjacent the upper portion to enable the person's body weight to elongate the person's neck to facilitate the alignment of the person's airways and to help open or enhance the passage of air into the person's lungs. Optionally, this head portion of the apparatus may be elongated or shortened such as by receiving inserts to adjust the head height of the person, for customizing the position and elevation of the person's head, facilitating or enhancing the opening of the person's air passages. These inserts may be made available in varying thicknesses to accomplish such customization, such as for example without limitation, one inch, two inches, and three inches.

DETAILED DESCRIPTION OF PREFERRED EMBODIMENTS

Figure 1:
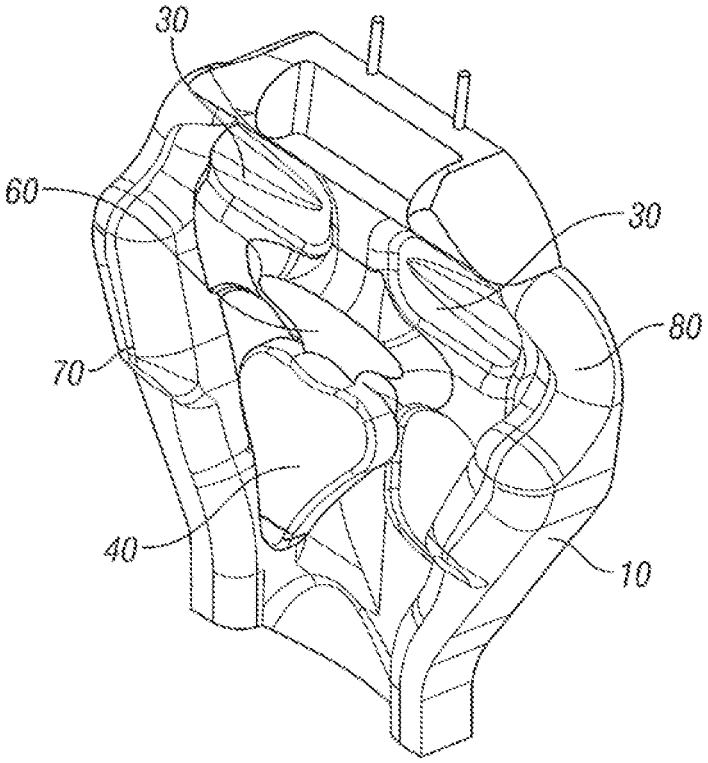
FIG. 1 is a front, perspective view of one embodiment of one embodiment of the apparatus of the invention.

This description of preferred embodiments is intended to be read in connection with the accompanying drawings, which are to be considered part of the entire written description of the invention. The drawing figures are not necessarily to scale and certain features of the invention may be shown exaggerated in scale or in somewhat schematic form in the interest of clarity and conciseness.

In the description, relative terms such as "top," "rear," front," "bottom," "horizontal," "vertical," and "diagonal" as well as derivatives thereof (e.g., "horizontally," "downwardly," "upwardly," "rotationally," "diagonally" etc.) should be construed to refer to the orientation as then described or as shown in the drawing figure under discussion. There relative terms are for convenience of description. Terms concerning attachments such as "connected," and "interconnected," refer to a relationship wherein structures are secured or attached to one another either directly or indirectly through intervening structures, as well as both movable or rigid attachments or relationships, unless expressly described otherwise. In the claims, means-plus-function clauses, if used, are intended to cover the structures described, suggested, or rendered obvious by the written description or drawings for performing the recited function, including not only structural equivalents but also equivalent structures.

The present invention provides an apparatus to facilitate or enhance a person's breathing that helps align and open the person's breathing passages, whether the person is in a reclining position or in a sitting position. As indicated in FIG. 5*c*, the reclining position may be at an angle, specifically any angle other than vertical, and may include a horizontal or "lying flat" position on a bed. Further, the airway alignment and improved posture afforded by the apparatus of the invention has the added benefit of enabling the body to have more efficient respiration and better digestion. Aligning the airways also helps to prevent deterioration of the esophagus lining that can result from use of a respiratory machine. Moreover, the apparatus of the invention simply affords the person to be able to rest in bed or sit in a chair without slumping for improved comfort and appearance.

The apparatus of the invention may be viewed as accomplishing its advantages by enhancing the posture of a person who is usually sensory and/or consciousness deficient, as may commonly be the case with persons in the hospital or confined to a wheelchair. Any number of circumstances can affect and detract from a person's ability to have good posture when sitting or even laying in bed. Examples of such circumstances include injuries from accidents, debilitating illnesses, strokes, diabetes ketosis conditions, and surgeries. By positioning the person's diaphragm and lungs, the apparatus of the invention naturally encourages better (e.g., deeper) breathing by the person. The person's lungs should generally accommodate a greater amount of air and the body will be able to hold more oxygen, which should enhance medical recovery.

The apparatus of the invention may be a single, multi-shaped structure, or it may be a combination of parts connected together, as will be further discussed below. All or portions of the apparatus might even be disposable. The apparatus may be at least partially inflatable, or it may be comprised of foam, most preferably memory foam, and/or a plastic. In one embodiment, the apparatus of the invention will comprise memory foam and a gel lining that will mold to the patient for added comfort.

Referring to the figures, apparatus 10 (10A in FIGS. 5*a*, 5*b*, and 5*c*) comprises a back or lower portion 31 of sufficient length to extend from a person's neck to slightly below the person's diaphragm, and of sufficient width to support the person's shoulder blades. As shown in FIGS. 1, 3, 4, 5*a*, 5*b*, and 5*c*, back portion 31 is convex to elevate the person's spine upwards such that the person's shoulders fall back to open or enhance the person's airways, distributing the person's weight back into the shoulders, and relieving pressure on the person's lungs in the chest area. Back portion 31 may be comprised of any material capable of substantially maintaining its shape when pressed by the weight of a person lying on it. In one embodiment, back portion 31 is comprised of plastic, preferably a flexible plastic that may be adapted to fit along the curvature of the user's spine. In another embodiment, back portion 31 is comprised of a hard plastic or steel, covered with a memory foam. In another embodiment, back portion 31 is covered in a non slip gel sole.

Figure 2:
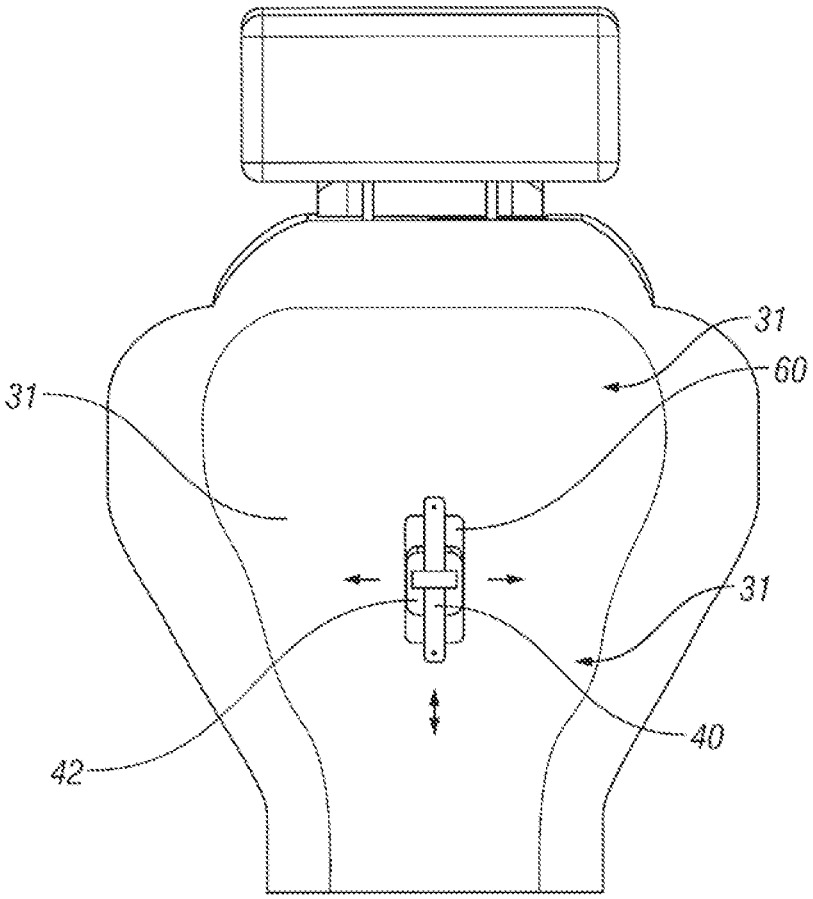
FIG. 2 is a rear view of the embodiment of the apparatus of the invention depicted in FIG. 1.
Figure 3:
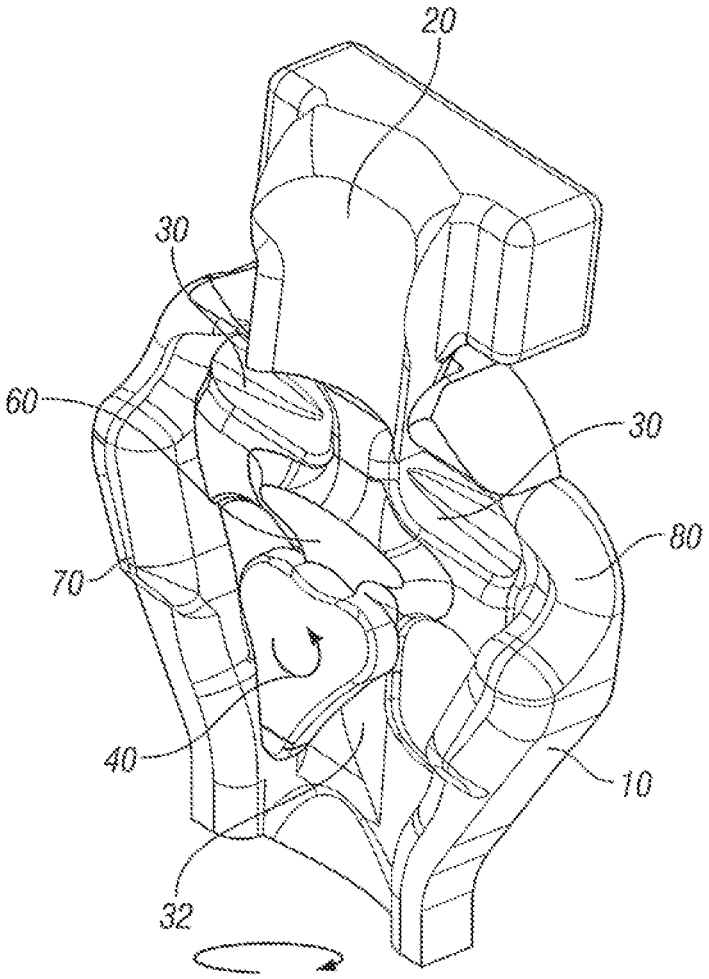
FIG. 3 is a front, perspective view of an alternative embodiment of the apparatus of the invention depicted in FIG. 1, with a head piece.
Figure 4:
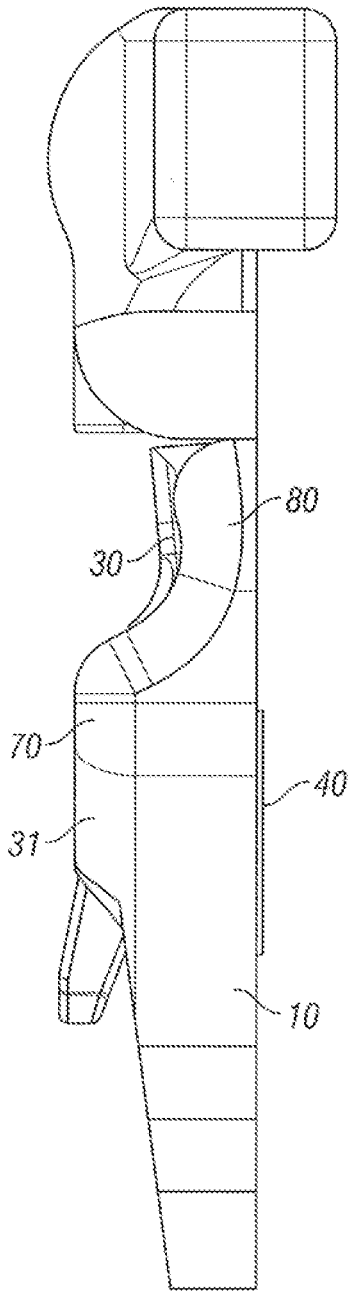
FIG. 4 is a side view of the embodiment of the apparatus of the invention depicted in FIG. 3.
Figure 5A:
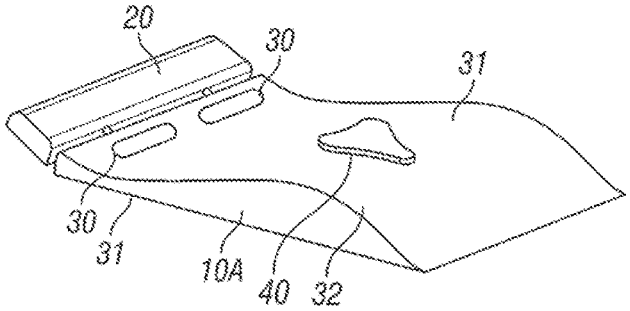
FIG. 5*a* is a top or front, perspective view of another embodiment of the apparatus of the invention.

In one embodiment, running down the middle of back portion 31, on the top or front side 32 as shown in FIGS. 1, 3, 5*a* and 5*b*, is a raised or raisable (convex) backbone portion 40, to be positioned along or adjacent to, the user's spine. Backbone portion 40 is thus designed to elevate the user's chest cavity upwards, facilitating improved expansion of that person's lungs to enhance the person's oxygen intake. In some embodiments, backbone portion 40 is a "working piece," as shown for example in FIGS. 1 and 3, capable of moving up and down, and/or back and forth, and/or side to side and/or may even be able to rotate due to a ball 42 inside as shown in FIG. 2. The shape of backbone portion 40 may be a modified triangular shape as shown in FIGS. 1 and 3, or a modified rectangular shape as shown in FIG. 5*a* or any variation thereof. That is, the exact shape of backbone portion 40 is not critical provided the shape allows functioning of the piece to elevate the user's chest cavity upwards.

Figure 5B:
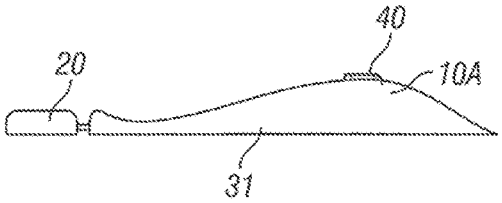
FIG. 5*b* is a side view of the embodiment of the apparatus of the invention depicted in FIG. 5*a*.
Figure 5C:
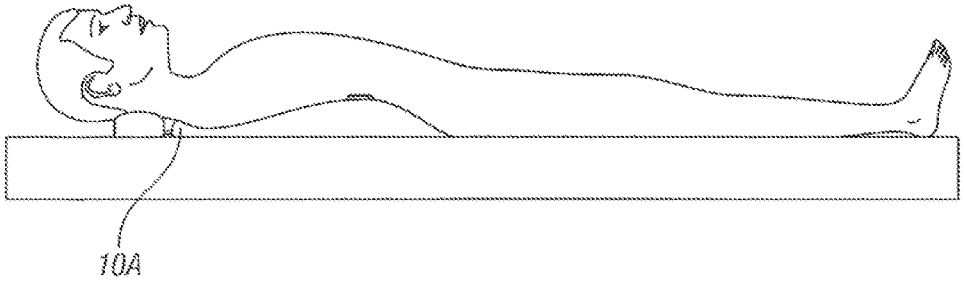
FIG. 5*c* is a side view of the embodiment of the apparatus of the invention depicted in FIG. 5*a* in place on an inclining bed.

The backbone portion 40 may be comprised of any material capable of substantially maintaining its shape when pressed by the weight of a person lying on it and may be comprised of any of the same or similar type materials as may be used for back portion 31. In one embodiment, the backbone portion 40 is comprised of plastic, preferably a flexible plastic that may be adapted to fit along the curvature of the user's spine. In another embodiment, the backbone portion 40 is comprised of a hard plastic or steel, covered with a memory foam. In another embodiment, the backbone portion 40 is covered in a non slip gel sole. Where back portion 31 is molded, as is common for a plastic or foam type material, the backbone portion 40, in one embodiment, may be included in that mold such that the back portion 31 and the backbone portion 40 are one molded piece, as shown in FIGS. 5*a* and 5*b*. Alternatively, backbone portion 40 may be one or more pieces that work together in apparatus 10 to effect the function of elevating the user's chest cavity upwards.

In some embodiments, the back portion 31 of apparatus 10 has a hole or slot 60 that facilitates or allows backbone portion 40, if a "working piece," to move up and down and/or forwards and backwards, and/or side to side and/or rotate. In some embodiments, apparatus 10 may have shoulder supports 70 and a cavity 80 for placement of arms and shoulders of the user.

Optionally, as shown in FIGS. 3 and 5*a*, 5*b* and 5*c*, the apparatus of the invention 10A further comprises head supports 30 which are preferably two pieces, positioned so on each side of the head of the user person when apparatus 10 is in use. Head supports 30 cradle the user person's head at the base of that person's skull and neck to help align or open the person's oral, pharyngeal and/or laryngeal structures comprising the person's airways. This head support 30 may optionally receive inserts (not shown), which may also be called "head height inserts," to modify the position provided by the head support 30 to the person's head. For example, such inserts may be about one inch, two inches, or three inches in thickness, and may be inserted within the main body of head support 30 to increase the angle and/or degree of position provided by head support to a person's head. The inserts may be comprised of any material that will at least substantially maintain its shape under the weight of a person's head, when the person is in a resting or horizontal position. Examples of suitable preferred materials for the insert include without limitation rigid or semi-rigid/flexible plastic, and various foams, although even hard materials such as hard plastics might alternatively be used. Ideally, all materials used in the apparatus will be relatively light in weight, to enhance the portability and ease of use of the apparatus.

The embodiment of the apparatus of the invention shown as apparatus 10 having a head support 30 may further have a support portion or piece (not shown adjacent the head support 30, particularly suited to provide support for the person's chin or provide a piece on which the person may rest his or her chin. This support portion may be comprised of any material that has sufficient flexibility to be comfortable to the user person while at the same time having sufficient rigidity to provide support to enable the person's body weight to elongate the person's neck to facilitate the alignment of the person's airways and to open or enhance the passage of air into the person's lungs. Examples of suitable materials for the support portion include without limitation semi-rigid plastics and various semi-rigid foams.

In some embodiments, the head support 30 has attached to it or associated with it a head cradling portion or skull support 20 which contributes further to positioning the head and neck for alignment so as to open the person's oral, pharyngeal and/or laryngeal structures comprising the person's airways. In one embodiment, such skull support 20 or the attachment of skull support 20 to head support 30 may be adjustable for different person's neck lengths. The skull support 20 may be comprised of the same or similar material or materials, or different materials, as the head support 30 and/or the back portion 31. That is, materials suitable for the head support 30 and the back portion 30 are also suitable for the skull support 20. In one embodiment, the head support 30, and if used, the skull support 20, are covered in a non slip fabric which may be washable or disposable.

In one embodiment, back portion 31 and head support(s) 30, and if used in the embodiment, skull support 20, may be prepared from or using a single mold so that they are connected or associated as one piece, as shown in FIGS. 5*a*, 5*b*, and 5*c*. Alternatively, in another embodiment, back portion 31 and head support 3010, and if used skull support 20, may be connected together, as shown for example without limitation in FIG. 3 with one or more connectors (not shown) connecting the skull support 20 and back portion 31 of the apparatus 10. The connector may be pivotal or flexible, and for further flexibility in positioning of the apparatus 10 under the user, even adjustable. The connector may also optionally be configured with releasers (not shown) that will release back portion 31 from skull support 20 when desired, so as to allow for disassociation or disconnection of back portion 31 from skull support 20, for exchange of different upper or back portions for further adaptation or customization for the user and/or simply for ease of cleaning.

Optionally, apparatus 10 may have or use straps for attaching apparatus 10 to a bed, stretcher, or wheelchair to help hold apparatus 10 in place for use. The straps may be attached to the apparatus 10 directly or may simply be fitted through inserts or strap receivers on apparatus 10 that are themselves attached to or otherwise a part of apparatus 10. The straps 25 may be comprised of a reusable, strong material, such as synthetic webbing or elastic for example or they may be comprised of a disposable material, such as a strong plastic or synthetic tape for example. The straps may be attached to the bed, stretcher or wheelchair in various ways, including without limitation velcro, buttons, tape, wrapping or an elastic hold.

In another embodiment, apparatus 10 further optionally comprises arm rests or arm supports and is adapted for use with a wheelchair without the need for straps, the apparatus forming instead the back portion of the wheelchair. In still another embodiment, apparatus 10 maybe formed as part of a bed or stretcher or chair, integral to same, eliminating the need for straps or other fasteners to hold apparatus 10 to the bed, stretcher, or chair.

The method of the invention may ideally be conducted by positioning a person on an apparatus of the invention in a reclining position such as on a bed or stretcher or in a sitting position as in a chair. The person should be placed face up, with his or her back adjacent the front side—the convex side—of the apparatus. That is, according to the method of the invention, the person's shoulder blades should be supported and the person's spine elevated upwards, such that the person's shoulders generally fall back and the person's weight is distributed more in the person's shoulders, to open or otherwise enhance the person's airways, and to relieve pressure on the person's lungs in the chest area. This may expand the person's chest cavity, facilitating expansion of the person's lungs to enhance oxygen intake and improve the person's breathing. Further, a person's breathing may be eased, facilitated or enhanced by cradling the person's head at the base of the person's skull and neck to align or open the oral, pharyngeal and/or laryngeal structures comprising the person's airways and enabling the person's body weight to elongate the person's neck to facilitate such alignment of the person's airways and to open or enhance the passage of air into the person's lungs. Optionally, the person's head may be elevated, as well as supported.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention.

Accordingly, the scope of protection is not limited by the description set out above, and each and every claim below, and its equivalents, are incorporated into the specification as an embodiment of the present invention. Thus, the claims are a further description and are an addition to the preferred embodiments of the present invention.

What is claimed is:

1. An apparatus to facilitate or enhance a person's breathing when in contact with the apparatus comprising:

(a) a convex back portion having a base surface and a contoured surface opposite the base surface, the contoured surface for bearing the weight of a person thereon, the convex back portion having a length extending from a person's neck area to at least a point in or around the vicinity of a person's diaphragm, the convex back portion including a first end and a second end, the first end having a first width and the second end having a second width, wherein the convex back portion has a point of maximum width between the first and second ends, the point of maximum width being greater than the first and second widths, and wherein laterally outward edges of the contoured surface include a raised shoulder support and a recessed cavity to accommodate arms of a person; and (b) a moveable raised backbone portion disposed adjacent the convex back portion and extending to a position elevated from the contoured surface and positioned to anatomically provide support to a spine of a person, the moveable raised backbone portion elevating an upper portion of the spine adjacent and bordering the person's chest cavity relative to the shoulders of the person in response to the convex back portion bearing the weight of the person in order to align and open the person's breathing passages.

2. The apparatus of claim 1, wherein the backbone portion is aligned parallel to the spine.

3. The apparatus of claim 1, further comprising a head portion positioned at the first end of the convex back portion, for support of a person's head to align or open the oral, pharyngeal and/or laryngeal structures comprising a person's airways.

4. The apparatus of claim 3, further comprising a skull support portion adjacent the head portion, to enable a person's body weight to elongate a person's neck to help facilitate the alignment of a person's airways and to open or enhance the passage of air into a person's lungs.

5. The apparatus of claim 4, wherein a distance between the skull support and the head portion is adjustable.

6. The apparatus of claim 4, wherein the skull support is covered in a non-slip fabric.

7. The apparatus of claim 1, wherein the convex back portion is covered in a non-slip gel sole.

8. The apparatus of claim 4, wherein the skull support is adjustable for different neck lengths.

9. The apparatus of claim 3, wherein the head portion and the back portion are connected via an adjustable fastener.

10. The apparatus of claim 1, wherein the convex back portion extends to a lumbar area of the person.

11. The apparatus of claim 1, wherein the convex back portion is flexible.

12. An apparatus to facilitate or enhance a person's breathing when resting thereon, the apparatus comprising:

(a) a convex back portion comprising a base surface and a contoured surface opposite the base surface for supporting the person's shoulder blades and spine and for elevating an upper portion of the spine adjacent and bordering the person's chest cavity upwards relative to the shoulders such that the person's shoulders fall posterior to the upper portion of the spine adjacent the chest cavity to open or enhance the person's airways, distribute the person's weight into the shoulders, and relieve pressure on the person's lungs in the chest area, the convex back portion including a first end and a second end, the first end having a first width and the second end having a second width, wherein the convex back portion has a point of maximum width between the first and second ends, the point of maximum width being greater than the first and second widths, and wherein laterally outward edges of the contoured surface include a raised shoulder support and a recessed cavity to accommodate arms of a person; and (b) an adjustable backbone portion support means disposed over the contoured surface for further elevating the person's chest cavity upwards, to improve the person's posture and facilitate improved expansion of the person's lungs to enhance oxygen intake.

13. The apparatus of claim 12, further comprising a head support means disposed at the first end of the convex back portion for cradling the person's head at the base of the person's skull and neck to align or open the oral, pharyngeal or laryngeal structures comprising the person's airways.

14. The apparatus of claim 12, further comprising an alignment means for enabling the person's body weight to elongate the person's neck to help facilitate the alignment of the person's airways and to open or enhance the passage of air into the person's lungs.

15. An apparatus to facilitate or enhance a person's breathing when resting thereon, the apparatus comprising:

a patient supporting means comprising a contoured surface for supporting the weight of a patient thereon, the patient support means configured to support a patient's shoulder blades and backbone/spine while elevating an upper portion of the spine adjacent and bordering the patient's chest cavity upwards relative to the shoulders such that the patient's shoulders fall posterior to the upper portion of the spine adjacent the chest cavity to open the person's airways, distribute the person's weight into the shoulders, and relieve pressure on the person's lungs in the chest area, wherein the patient supporting means includes a first end and a second end, the first end having a first width and the second end having a second width, wherein the patient supporting means has a point of maximum width between the first and second ends, the point of maximum width being greater than the first and second widths, and wherein laterally outward edges of the contoured surface include a raised shoulder support and a recessed cavity to accommodate arms of a person; and a spine elevating means coupled to the patient support means and extending beyond a plane of the contoured surface, the spine elevating means positioned to anatomically provide support to a spine of a patient and to reposition the lungs and diaphragm of the patient to facilitate deeper breathing of the patient.

* * * * *